US006581970B1

(12) United States Patent
Lein

(10) Patent No.: US 6,581,970 B1
(45) Date of Patent: Jun. 24, 2003

(54) MODIFIED BOOK BINDING

(75) Inventor: Torsten Lein, Pforzheim (DE)

(73) Assignee: Copy-Lein GmbH, Dessau (DE)

( * ) Notice: Subject to any disclaimer, the term of this patent is extended or adjusted under 35 U.S.C. 154(b) by 0 days.

(21) Appl. No.: 09/914,670

(22) PCT Filed: Feb. 29, 2000

(86) PCT No.: PCT/DE00/00579

§ 371 (c)(1),
(2), (4) Date: Aug. 31, 2001

(87) PCT Pub. No.: WO00/51828

PCT Pub. Date: Sep. 8, 2000

(30) Foreign Application Priority Data

Mar. 3, 1999 (DE) ..... 199 09 186

(51) Int. Cl.[7] ..... B42D 1/00

(52) U.S. Cl. ..... 281/21.1; 281/15.1; 281/36; 412/37; 412/39

(58) Field of Search ..... 281/21.1, 15.1, 281/36, 37, 23, 34, 35, 33, 29, 45, 51; 412/1, 4, 37, 36, 900, 902

(56) References Cited

U.S. PATENT DOCUMENTS 3,833,244 A * 9/1974 Heimann ..... 281/21.1
4,289,330 A * 9/1981 Wiermanski ..... 281/21.1
5,078,563 A * 1/1992 Lolli ..... 412/8
5,425,554 A * 6/1995 Lamanna ..... 281/21.1

FOREIGN PATENT DOCUMENTS

| | | |
|---|---|---|
| DE | 49 201 | 10/1888 |
| DE | 197 29 708 | 9/1998 |
| EP | 0 641 674 | 9/1993 |
| EP | 0 719 655 | 12/1995 |
| WO | 82/03824 | 11/1982 |

* cited by examiner

*Primary Examiner*—Willmon Fridie, Jr.
(74) *Attorney, Agent, or Firm*—Collard & Roe, P.C.

(57) ABSTRACT

The invention relates to a novel book cover which is used together with the known firm bindings, that is U-shaped steel bars. According to the invention, a flexible support material is arranged in two layers and in parallel to the flanks of a U-shaped bar. The layers of the book cover that are in parallel to the flanks are intimately glued together except for a flexible connection of two layers, that is either the support material is flexibly arranged in relation to its two layers or—as shown in FIG. 1—the inner surface of the flank is flexibly arranged in relation to the layer. The resin layer usually fixes the leaves, the resin layer being applied on the transversal insert of the support material. The transversal insert rests against the base of the U-shaped bar, that is it is not firmly linked with it, when the book is closed. When the book is opened, the bound leaves are vertically moved, thereby allowing the leaves to be turned so that they lie flat.

5 Claims, 8 Drawing Sheets

MODIFIED BOOK BINDING

CROSS REFERENCE TO RELATED APPLICATIONS

Figure 2:
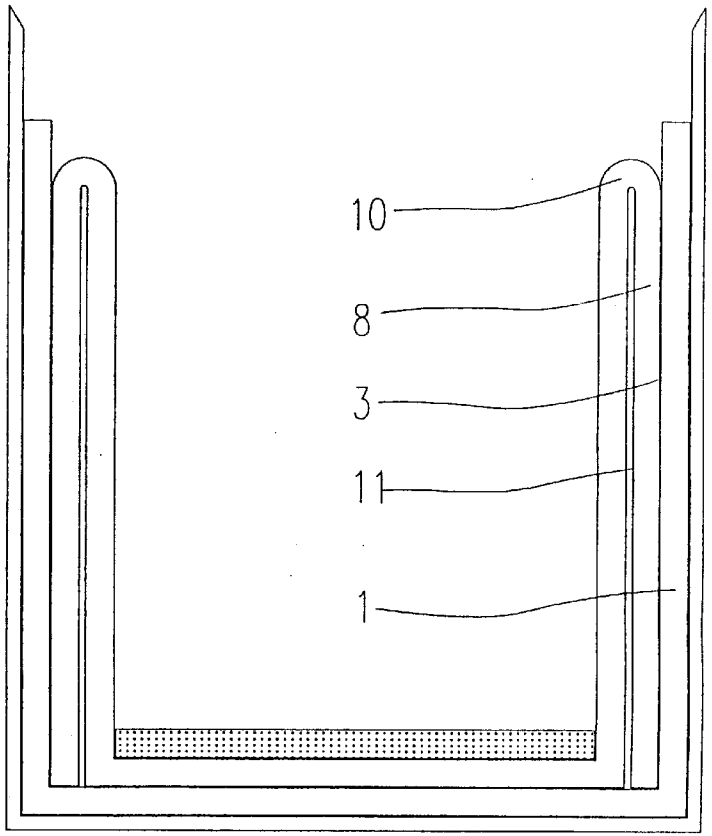

Applicant claims priority under 35 U.S.C. §119 of GERMAN Application No. 199 09 186.2 filed on Mar. 3, 1999. Applicant also claims priority under 35 U.S.C. §120 of PCT/DE00/00579, filed on Feb. 29, 2000. The international application under PCT article 21 (2) was not published in English.

The invention concerns a new book binding, which is applied using the known hardback bindings made of metal. The invention will preferably be used for binding pamphlets, brochures and reports. Use according to the invention can also cover binding approx. 400 pages and more. The modified binding has many design versions, which the decisive new ideas underlie, whereby all versions also have the corresponding advantages over conventional solutions.

Traditional binding has long been a tried and tested process. However, it requires a long processing time and is therefore very cost-intensive.

Other binding processes are paperback and the hardback binding by means of metal, in particular steel, already mentioned. With paperback binding the strength is not optimal. In hardback binding with the use of a metal rail the drawback is that it is difficult to open the book. Unobstructed reading in the area of the book binding is also often only possible if the pages have to be held apart with a certain exertion of force. As soon as the hand is removed from a book bound in such a way, the pages frequently turn themselves over. According to experience such bindings lead to certain problems when using books, as it is annoying if pages turn themselves as soon as the book is placed down in an open position.

It is also known that the horizontal surface of a U-section made of metal is coated with resin on the inside. In this connection reference is made to EP 0719655 A1. When binding is being carried out in the binding device, the resin is heated and consequently changed into a plastic state so that the pages placed vertically onto the horizontal surface of the U-section sink into the resin. After cooling, the pages are fixed. It should be emphasised that the U-section according to the state of the art is lined on the outside. Imitation leather is often used for this.

Furthermore, a binding according to DE 197 29 708 A1 is known. Accordingly a cardboard-strengthened binding, consisting of one part, is glued onto the external surfaces of a U-section made of metal. For technical reasons, this gives a tasteful design to the binding. In this DE 197 29 708 A1 several versions are described, e.g. that between the flanks of the U-section a soft sheeting is aligned that is welded with a transparent sheeting, serving to protect the bound printed products and allowing them to be viewed. One of the other versions of the aforementioned disclosure also assumes that the cardboard-strengthened binding completely covers the U-section. Complementary to this it is proposed that by gluing the cover material at the ends of the flanks of the U-section and by gluing the cover material with the materials aligned on the internal sides of the flanks of the U-section, a new kind of binding is created.

According to EP 0 641 674 A1 a book-binder is recognized by the solid U profile made of conductive material (ex. metal) in which the pages are glued in place. On the parallel flanks of the U profile a flexible carrying material is used to connect the U profile.

The bindings described briefly here, using a U-shaped metal rail, fulfil their task with respect to the strength of the binding. However, it should not be overlooked that with a hardback binding using a metal rail, the above-mentioned problem arises in each case that it is more difficult to open the book or the pages turn themselves as soon as the book is removed from the hand.

The WO 82 03 824 A doesn't include the U-Section in which the pages are bound. Instead a plastic housing is used that is tied with one band. Since a stabilizing U profile is missing, the solution will be according to EP 0 077 795 B1 for only special uses.

It is therefore the task of the invention to propose a binding that allows very easy handling of the bound book, brochure, etc. It should definitely be possible to open the book flat. The binding should be durable and useable for a long time. The binding method that allows the manufacture of the binding according to the invention should be secure when handled (positioning of the pages) and quick to produce. Accordingly the new binding should be cost-effective.

According to the invention the task will be solved as follows, whereby reference is made to Patent Claim 25 as far as the underlying inventive idea is concerned. The further development of the invention arises from Patent Claims 26 to 29.

Further remarks are to follow for the presentation of the invention.

It is assumed that the binding is carried out by using a binding made of metal designed as a U-section. The hardback binding according to the state of the art becomes a moveable binding according to the invention by the use of the U-section. Accordingly, flexible base material is used, applied in the area of each flank of the U-section. (A coated U-section is used if required). By turning the pages, the base material is always used in two layers. At the upper end of the flanks of the U-section a moveable base material connection is formed in the area where the pages are turned, in other words a kind of "joint". Accordingly, always two surfaces in the area of the flanks are moveable (can be shifted vertically), whereas all the other surfaces are bound tightly together by gluing. Depending on the design version used, the surfaces are aligned to each other moveably by two quires or one quire and a section surface.

If special design versions use additional flexible base material, which is aligned parallel to the flanks and the sole of the U-section, the aforementioned principle still applies that the two quires formed by turning the flexible base material form a kind of "joint" in the area where the pages are turned.

So that the vertical shifting can take place when the book is opened, there must still be a cross-connection of the flexible base material parallel to the sole of the U-section. This cross-connection only lies on the sole of the U-section. It is not connected with the U-section sole.

The upper layer on the U-section sole is thermosetting adhesive (hereafter described as a resin layer), by the use of which the pages are fixed. As a result of the fact that shifting can occur in the flank area and the cross-connection lies loosely on the sole of the U-section, the resin layer with the attached pages is moved vertically when the book is opened even with a hardback U-section made of metal. The book can then be opened flat and further requirements of the binding, as resulting from the task set for the invention, are fulfilled.

Opening the book with a solid U-Section made of metal and an adhesive with attached pages is possible. A flat opening of the book and other uses of the binder described previously are fulfilled.

It should also be pointed out that instead of the thermosetting adhesive a cold-bonding method can be used for fixing the pages. In addition, a welding process of two adhesive bases is conceivable.

The invention is now to be explained by means of design examples.

The following reference marks mean:

1—U-section made of metal, preferably steel
2—flanks of the U-section
3—inner flank surface of the U-section
4—outer flank surface of the U-section
5—Sole of the U-Section
6—flexible base material
7—quire of the flexible base material
8—quire of the flexible base material
9—cross-insert of the flexible base material
10—joint
11—slit
12—adhesive connection
13—resin layer
14—coating of the U-section
15—binding material
16—binding cover
17—joint as a connection between the binding material and the binding cover
18 —protective strip—detachable
19—bound pages
20—decorative material
21—filing strip
22—double-sided adhesive base
23—perforation With the use of the reference marks it should be noted that in order to avoid repetition not all the parts are always labeled with all the reference marks in the individual figures.

1. Design Example—see FIG. 1

The modified binding consists of a U-section 1 and the flexible base material 6, which is aligned in two quires 7, 8 at the flanks 2 of the U-section 1. The resin layer 13 holds the bound pages 19, whereby the resin layer 13 is glued with the cross-insert 9 of the flexible base material 6. The cross-insert 9 of the base material 6 is not connected with the sole 5 of the U-section. Between the inner flank surface 3 of the flank 2 and the quire 7 there is a slit 11. The outer flank surface 4 is fixed with the quire 8 by the adhesive connection 12. The area 10, i.e. where the turning of the flexible base material 6 occurs, is formed as a kind of "joint" 10 and this is how it functions. When the book is opened, the resin layer 13 adjusts itself with the fixed cross-connection 9 beneath to the bound pages 19. The movement is possible by means of the "joint" 10 and the moveable connection, the slit 11, between the inner flank surface 3 and the quire 7 of the flexible base material 6. It is suitable to use fabric for the base material 6.

A double-sided adhesive base is labelled with the position mark 22 and a detachable protective strip with the position mark 18. This design version is intended for individual layout and a variety of reading materials can be inserted into it.

2. Design Example—see FIG. 2

It is noted that a layer 8 of the base material is fixed together with the inner flank surface 3 of the U-section 1. The fact that it can be moved vertically is due again to the slit 11 and the joint 10.

Figure 3:
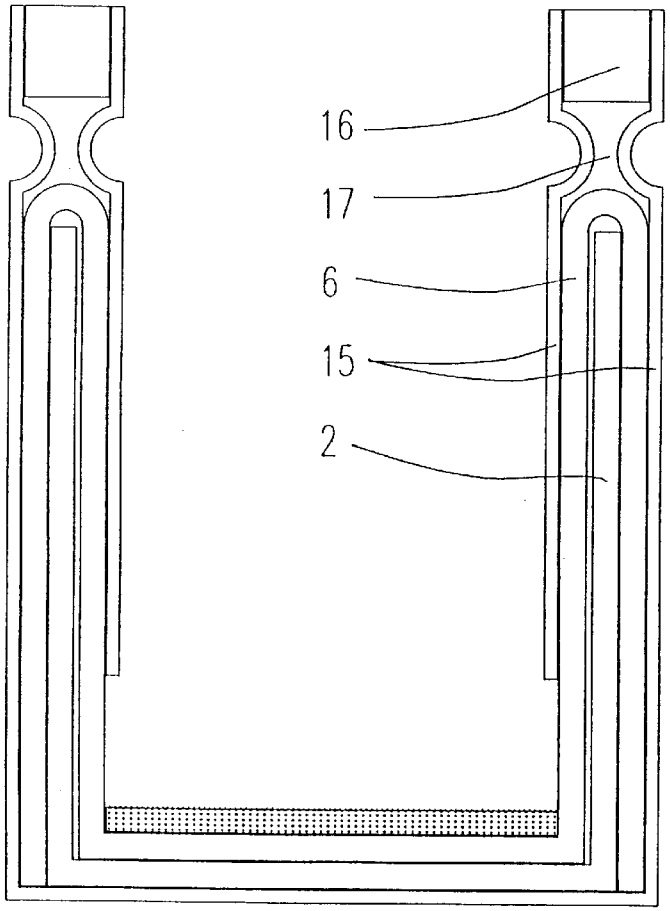

3. Design Example—see FIG. 3

Figure 1:
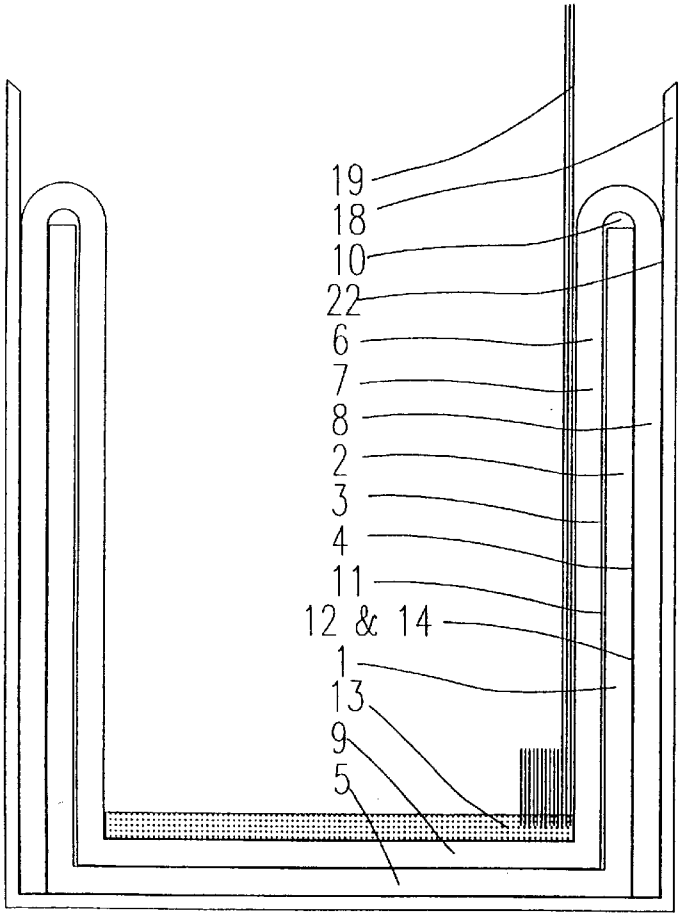

Similar to FIG. 1, a similar solution is shown here. Binding material 15 encloses the flexible base material 6, whereas the latter encloses the flank 2. At the end of the flanks 2 there is a joint as a connection between the binding material and the binding cover 17, which is attached to the binding material 15 and cover 16.

Figure 4:
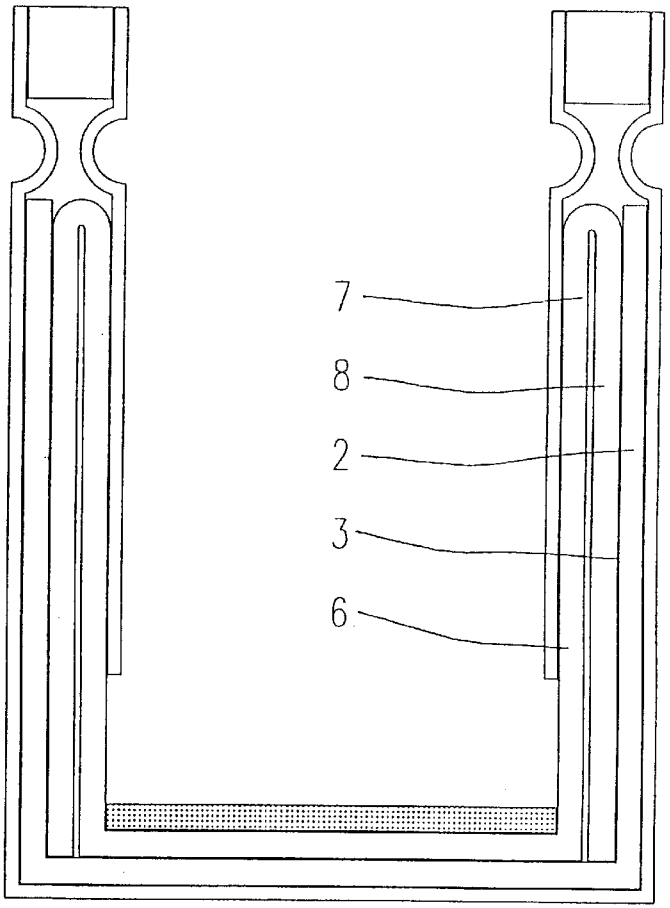

4. Design Example—see FIG. 4

Referring to FIG. 2, a similar solution is offered again. At the ends of the flanks 2 a flexible joint 17 serves as a flexible connection between the binding material 15 and the binding covers.

Figure 5:
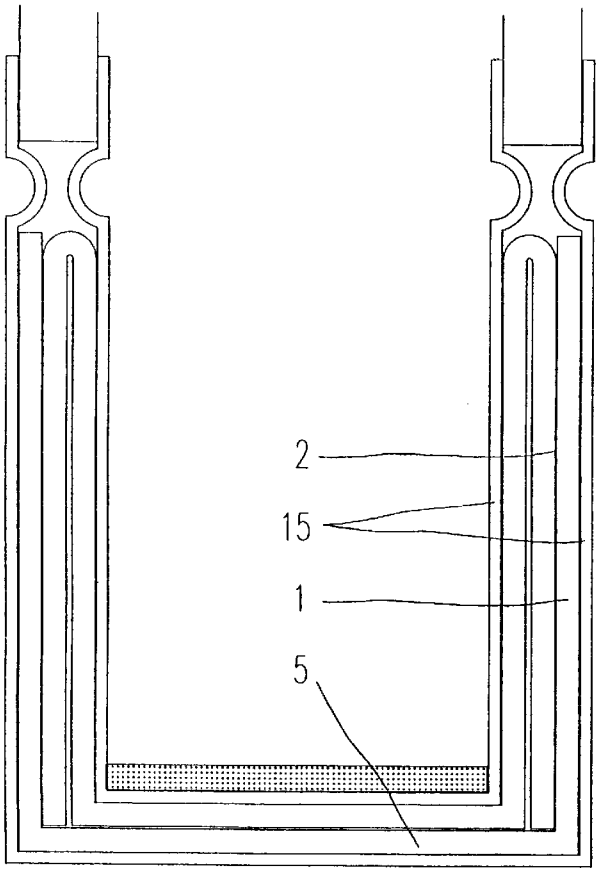

5. Design Example—see FIG. 5

The fifth design example is a modification of the fourth design example. The binding material 15 produces a material connection from one flank 2, under the resin layer 13, to the other in the area of the sole of the U-section 5.

Figure 6:
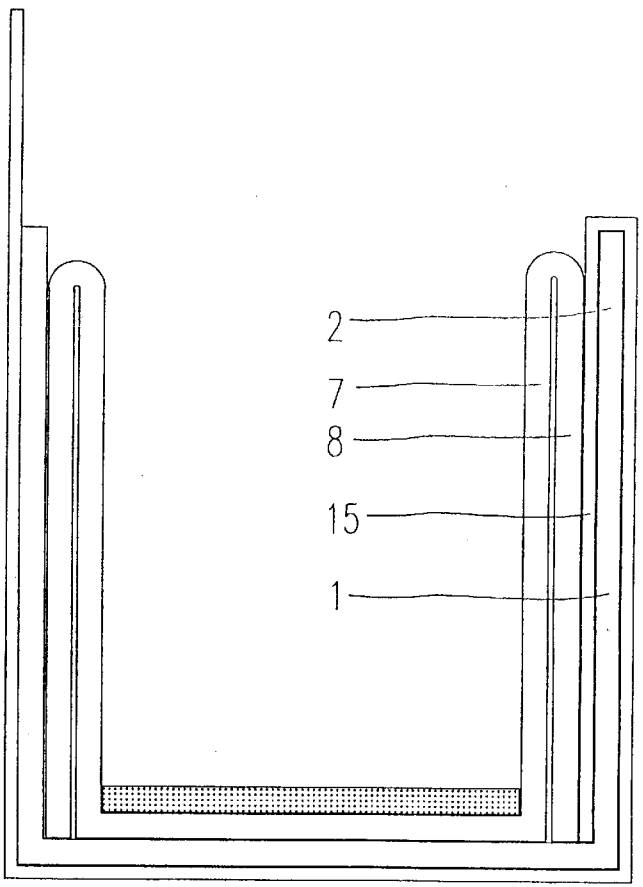

6. Design Example—see FIG. 6

This is an unsymmetrical binding viewed in the cross-section of the U-section 1. The left side of the U-section 1 corresponds in structure to FIG. 2, whereas with the right side of the U-section 1 the flank 2 is enclosed by a sheeting 15.

7. Design Example—see FIG. 7

Figure 7:
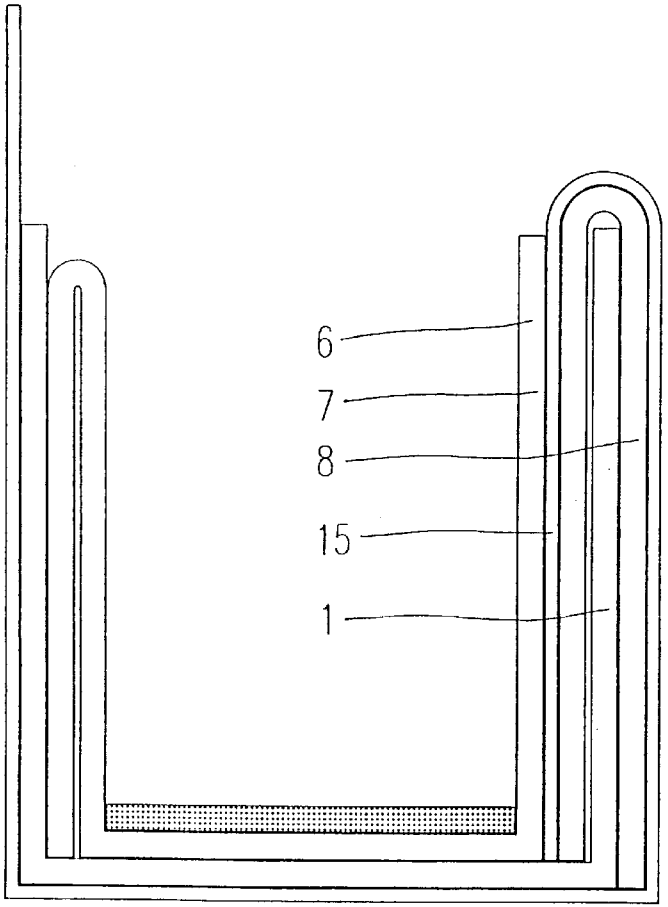

The unsymmetrical structure of the cross-section of the binding is also present according to FIG. 7. The left side of the U-section 1 corresponds in structure to FIG. 2, whereas with the right side of the U-section 1 the base material with its quires 7, 8 surrounds the U-section 1. In addition, a quire of the base material 6 is aligned parallel to the sheeting 15.

Figure 8:
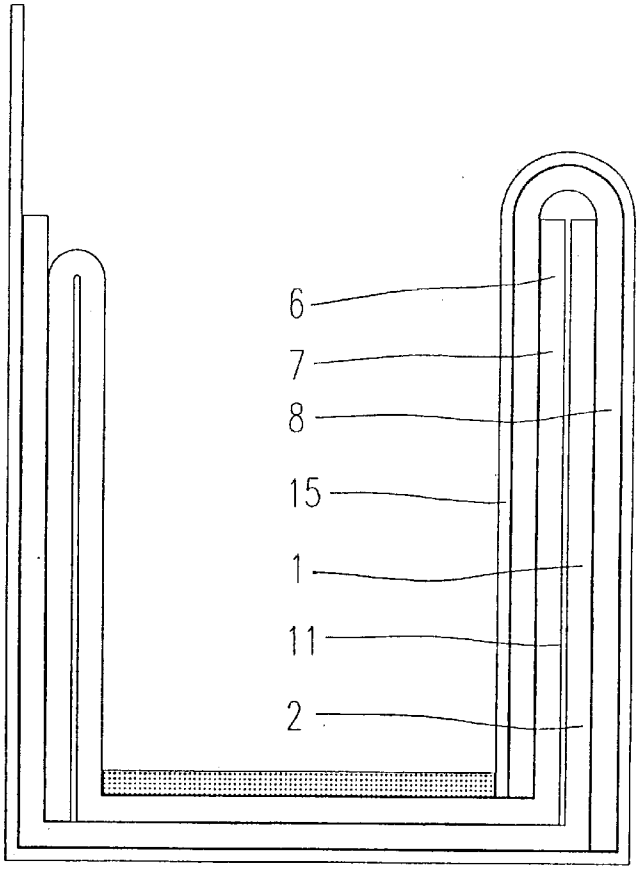

8. Design Example—see FIG. 8

The left side of the U-section 1 corresponds again to FIG. 7. On the right side of the U-section the two quires 7, 8 of a flexible base material can be found again. The binding material 15 encloses the right flank of the U-section completely. Between layer 8 of the flexible base material, the binding material 15 and the outer flank surface of the U-section there is a fixed adhesive connection.

9. Design Example—see FIG. 9

Figure 9:
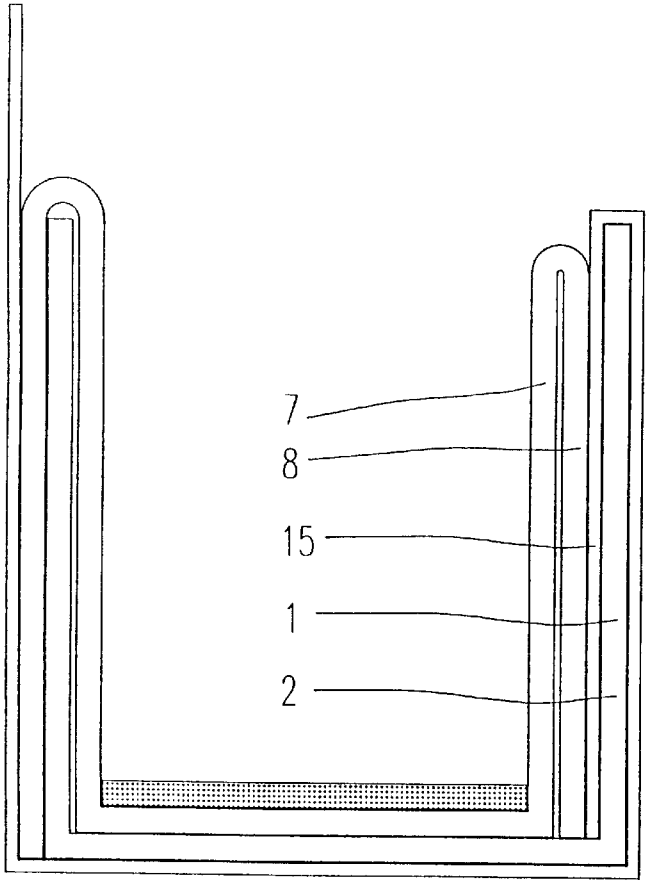

On the left side of the U-section, FIG. 9 shows the U profile 1 of FIG. 1. The right side of FIG. 9 corresponds to FIG. 6.

10. Design Example—see FIG. 10

The outer flanks 2 of the U-section 1 are fitted with decorative material 20. The base material 6 with the quire 8 is fixed with the binding material 15 and this in turn with the decorative material 20. The binding cover 16 is glued or welded with the binding material 15.

Figure 11:
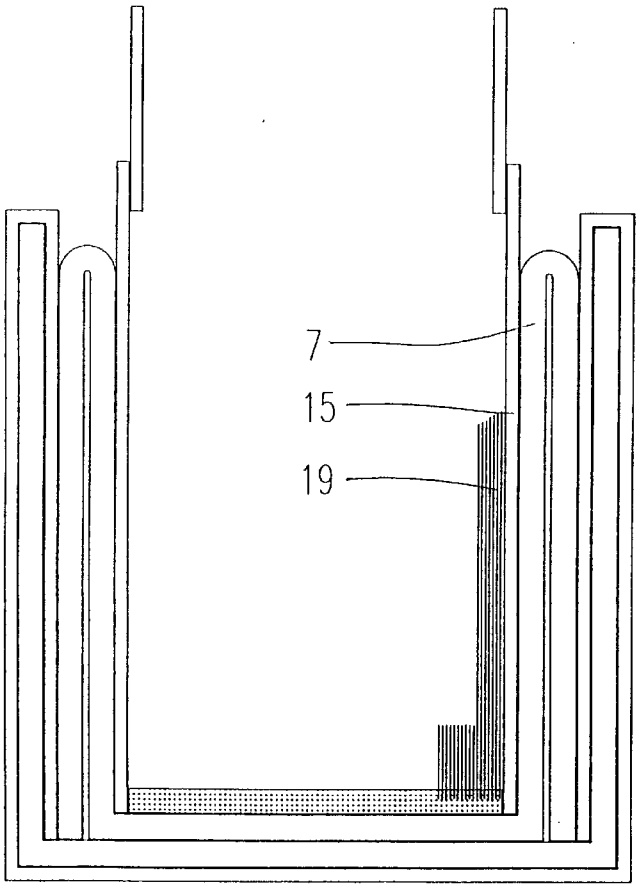

11. Design Example—see FIG. 11

Figure 10:
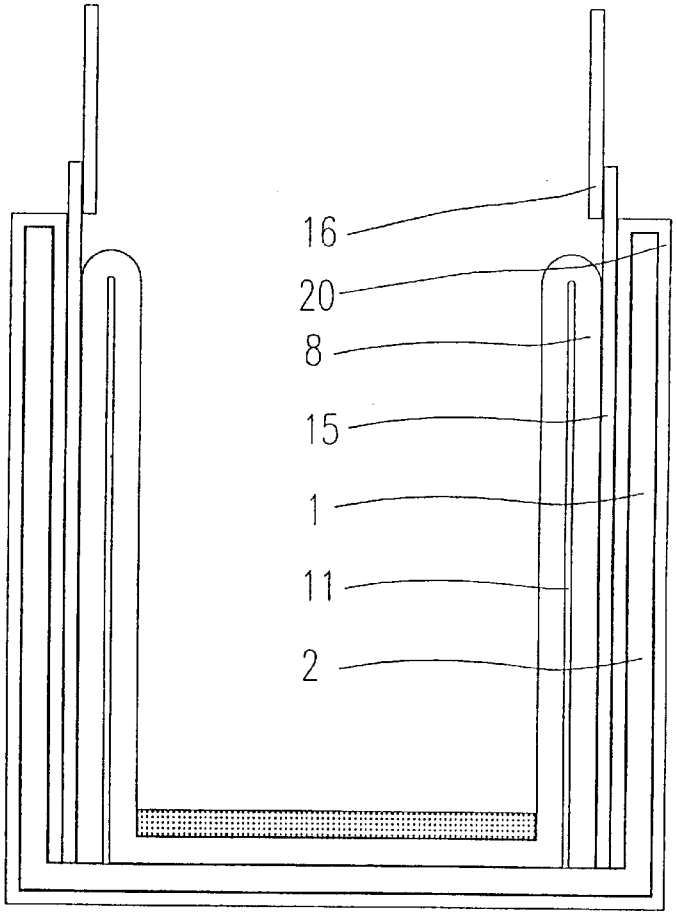

As a modification to FIG. 10 the binding material 15 is between the quire 7 and the bound pages 19.

12. Design Example—see FIG. 12

This is a symmetrical binding viewed in cross-section. Both flanks 2 of the U-section 1 correspond in their layer structure to the right side of the U-section FIG. 7. However, corresponding to FIG. 12, unlike the right side of the U-section in accordance with FIG. 7, the binding material 15 is aligned in such away that it is in direct contact with the pages to be bound 19.

Figure 13:
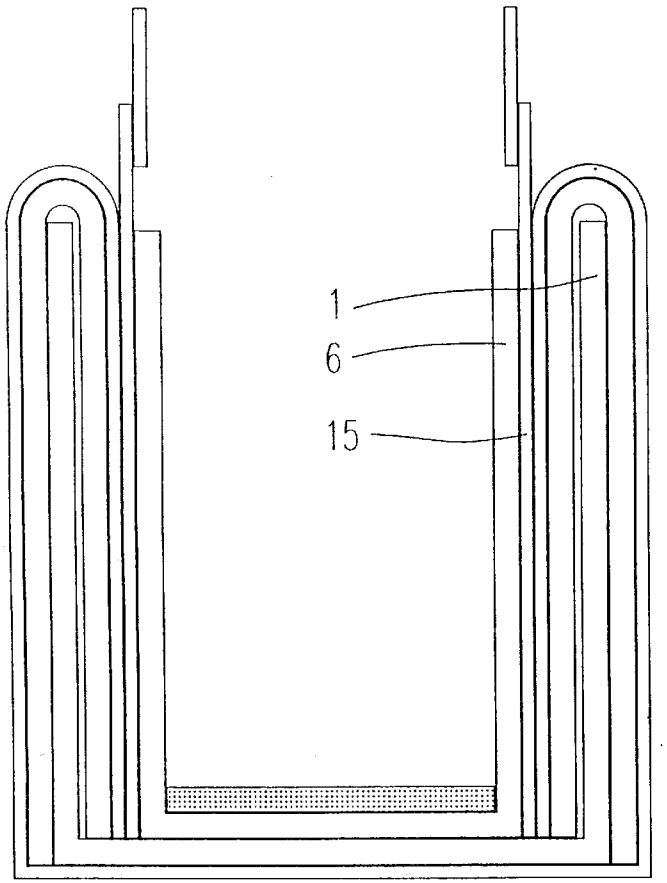

13. Design Example—see FIG. 13

This is a symmetrical binding viewed in cross-section. As a modification to the right side of the U-section 1 according to FIG. 7, the binding material 15 is aligned between a soft sheeting and additional flexible base material 6.

Figure 14:
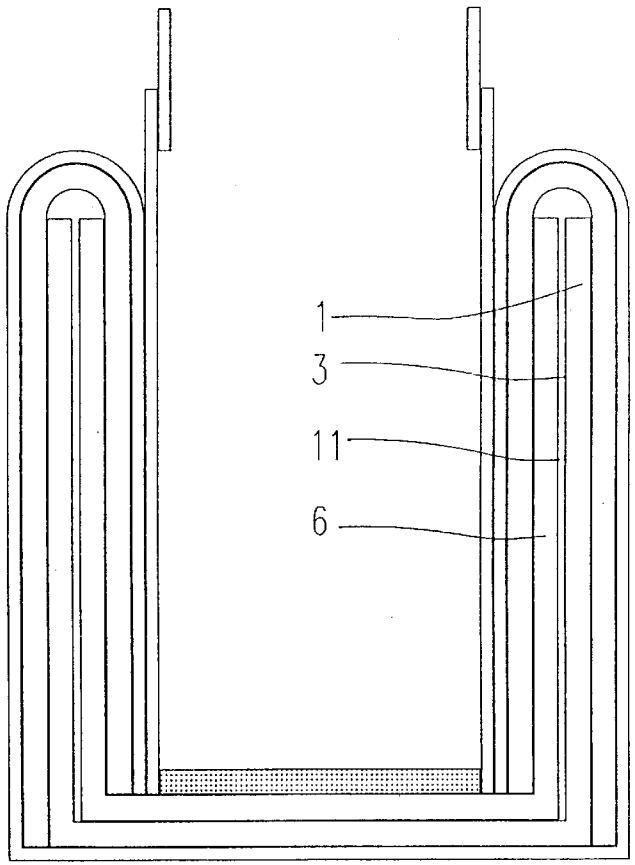

14. Design Example—see FIG. 14

Figure 12:
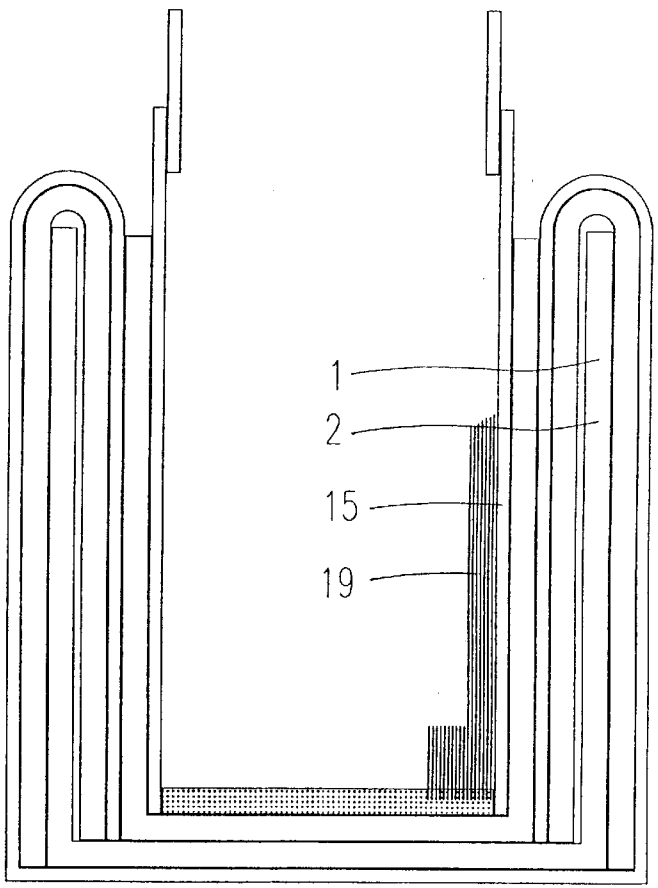

This symmetrical binding viewed in cross-section is comparable to FIG. 12 to a certain extent, however the base material differs from the layered build up of the Flanks 2 of U-Section 1.

Figure 15:
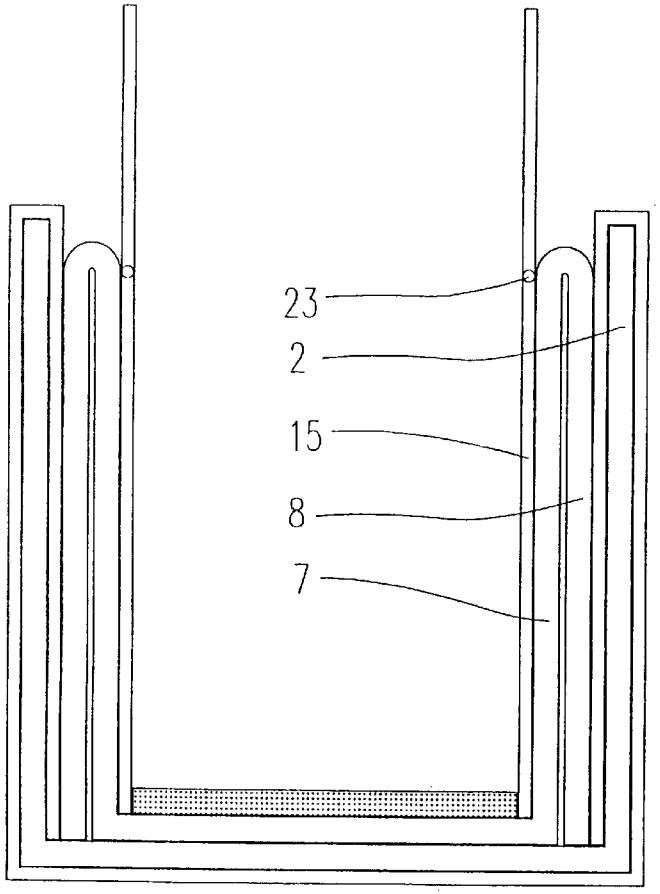

15. Design Example—see FIG. 15

The U-section 1 is covered at the flanks 2 by means of decorative material 20. The flexible base material with the quire 8 is fixed with the decorative material 20, whereas on the quire 7 of the flexible base material 6 a quire of paper 15 is glued with a perforation 23. The paper 15 is removed at the perforation 23 after binding by being torn out.

16. Design Example—see FIG. 16

Figure 16:
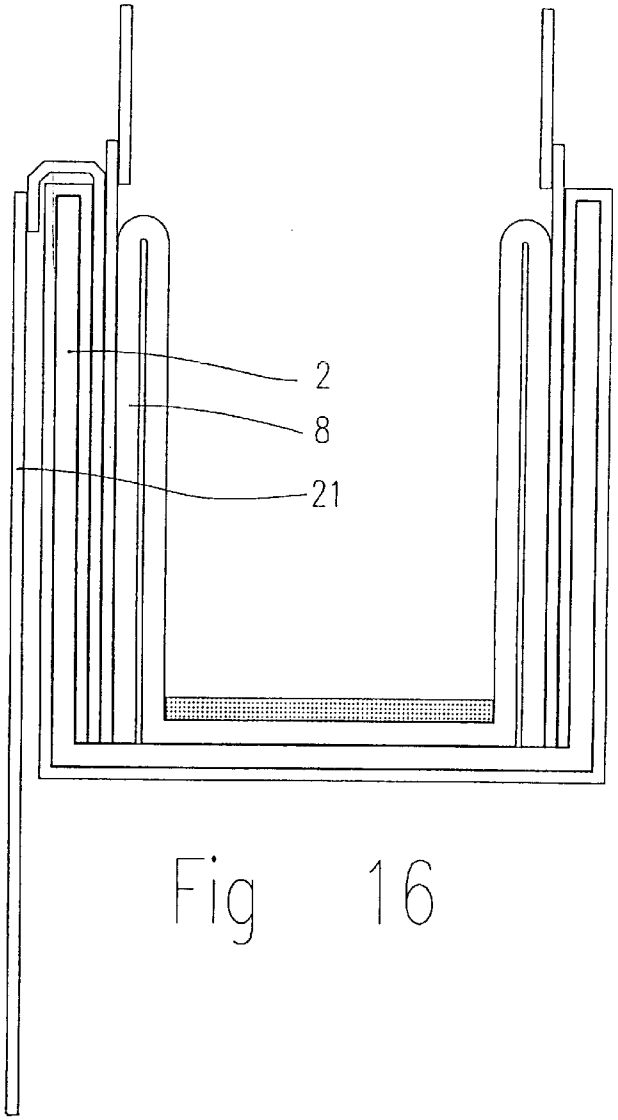

According to FIG. 16 a modified binding according to FIG. 10 is displayed, whereby a soft sheeting is aligned additionally between the left flank 2 and the quire 8. A filing strip 21 with filing perforation is welded to this soft sheeting. By turning over the soft sheeting it is possible to file the bound printed material.

What is claimed is:

1. A modified binding using a hardback U-shaped section as a book spine with a sole surface and a plurality of flanks situated at a right angle to the sole surface, wherein a plurality of pages are disposed between said plurality of flanks, said binding comprising:

a) a resin layer extending parallel to the sole surface said resin layer for binding said plurality of pages to said sole surface; and b) a flexible base material disposed between the sole surface of the U-shaped section and said resin layer, said flexible base material comprising:

i) a plurality of quires wherein said plurality of quires are both parallel to the two right angle flanks of the U-shaped section forming a double layer, wherein one of the two right angle flanks is glued to at least one of said plurality of quires; and ii) a cross insert being coupled to the sole surface and extending transversely to the right angle flanks;

wherein upon opening the book, the bound pages on said resin layer along with said flexible base material and the plurality of flanks of the U-shaped section move so that said flexible base material and said plurality of quires form a joint where said plurality of quires on the plurality of flanks conform to the U-shaped section.

2. The modified binding according to claim 1, wherein said plurality of quires form an inner quire and an outer quire with respect to the U-shaped section, and wherein said inner quire is bound with an inner flank surface of the U-section.

3. The modified binding according to claim 3, wherein said plurality of quires are each aligned parallel to the two flanks of the U-shaped section, wherein an outer flank surface of the U-shaped section is bound to said otter quire.

4. The modified binding according to claim 1, wherein the plurality of flanks of the U-shaped section are parallel to said flexible base material, and wherein the binding further comprises a flexible one sided material, wherein both sides of the U-shaped section are covered with said one sided material, wherein said one sided material is at an end of the flanks of the U-section; and a joint and a cover wherein said joint flows into said cover.

5. The modified binding according to claim 2, wherein said inner quire of said plurality of quires is coupled to at least one side of the U-shaped section parallel to at least one of the plurality of flanks, wherein an upper end of at least one of the plurality of flanks ends so that said inner quire connects to said outer quire, wherein a folding to said flank material forms two layers.

* * * * *